US005749122A

United States Patent [19]

Herbst

[11] Patent Number: 5,749,122

[45] Date of Patent: May 12, 1998

[54] INTERIOR DOOR CLOSER AND METHOD

[76] Inventor: Walter B. Herbst, 1875 N. Pond La., Lake Forest, Ill. 60045

[21] Appl. No.: 582,920

[22] Filed: Jan. 4, 1996

Related U.S. Application Data

[63] Continuation-in-part of Ser. No. 480,693, Jun. 7, 1995, Pat. No. 5,634,508.

[51] Int. Cl.[6] ..... E05F 1/08; E05F 3/02

[52] U.S. Cl. ..... 16/70; 16/65; 16/76

[58] Field of Search ..... 16/66, 67, 65, 16/70, 75, 76, 77, 78, 80, DIG. 10

[56] References Cited

U.S. PATENT DOCUMENTS

| | | | |
|---|---|---|---|
| 539,893 | 5/1895 | Frisbie | 16/70 |
| 675,041 | 5/1901 | Haldeman | 16/76 |
| 1,705,334 | 3/1929 | Otto | 16/70 |
| 1,899,716 | 2/1933 | Norton | 16/70 |
| 2,880,450 | 4/1959 | Newell | 16/70 |
| 5,634,508 | 6/1997 | Herbst | 160/371 |

FOREIGN PATENT DOCUMENTS

| | | | |
|---|---|---|---|
| 739474 | 9/1943 | Germany | 16/65 |

*Primary Examiner*—A. L. Pitts
*Assistant Examiner*—Donald M. Gurley
*Attorney, Agent, or Firm*—Jack E. Dominik

[57] ABSTRACT

A hidden door closer is based upon the positioning of a torsional spring adjacent the hinge edge of a door, which door has a hollow interior hidden closer portion with a closer mounted in an access opening so that the torsional spring and its housed assembly can be mounted in the opening is disclosed. The closer is mounted on the hinge side of the door. The torsional spring has a mid-portion crank which extends through an access opening with a coupler to the jamb or door frame. A pneumatic dampener is mounted in opposed relation to the torsion spring crank to slow the closing action induced by the Coil spring. Adjustment elements are provided in the dampener to emperically adjust its action prior to and after installation.

12 Claims, 3 Drawing Sheets

INTERIOR DOOR CLOSER AND METHOD

CROSS-REFERENCE TO RELATED APPLICATION

The present application is a continuation-in-part of application Ser. No. 08/480,693, filed Jun. 7, 1995 by the same inventor herein, entitled "Molded Door", and now U.S. Pat. No. 5,634,508.

FIELD OF THE INVENTION

The present invention relates to door closers, and more particularly that type which can be positioned interiorly of a door formed from two opposing members, front and rear, such as exemplified in U.S. Pat. No. 4,311,183.

SUMMARY OF THE PRIOR ART

The prior art is best illustrated in U.S. Pat. No. 4,311,183 of Jan. 19, 1982 in which the inventor is the inventor of the present application. The door of U.S. Pat. No. 4,311,183 is secured to the door frame by means of a hinge. Additionally, in Class 16, subclasses 49, 65, and 70 other patents relating to door closers are identified.

U.S. Pat. No. 443,702 to Wood discloses a door pneumatic door check and spring comprising cylinder, toggle 6 linkage and a spring on a pin cross-wise to action. This is an ancient patent exemplary of the subclass. U.S. Pat. No. 1,352,980 to Liming discloses a door check and closer having two parallal-acting springs on a pivot pin, a lever toggle linkage and pneumatic dampener. U.S. Pat. No. 614,909 to Warner discloses a door check and closer exteriorly mounted having springs, a toggle linkage, and dampener cylinder.

U.S. Pat. No. 4,369,545 to Maublanc discloses door check and closer assembly mounted inside a door having an axial spring, toggle linkage and dampener. The first of the above-three patents do use a torsion spring for closing the door, but they are all outside of the door. The fourth patent to Maublanc, U.S. Pat. No. 4,369,545 discloses an interior mounted closer, but utilizes a complex mechanism which pre-empts a large portion of the interior portion of the door, and requires a complex rack and pinion mechanism which significantly increases its inherent cost.

As a result of the above, what is highly desirable is a door closer which can be positioned at any portion along the hinge portion of the door. Exemplary is the door closer of co-pending application Ser. No. 08/480,693 filed Jun. 7, 1995. More specifically, it may be even more desirable to have a plurality of such closers which are spaced to avoid inducing torsional loads on the door hinge. In addition, to provide a door closer which is totally interiorly mounted of the door is highly desirable since it will eliminate the unsightliness of a door closer on the interior portion of the door, and yet provide as good or better a door closing effort.

SUMMARY OF THE INVENTION

The present invention of a hidden door closer is based upon the positioning of a torsional spring adjacent the hinge edge of a door, which door has a hollow interior hidden closer portion with a closer mounted in an access opening so that the torsional spring and its housed assembly can be mounted in the opening. The closer is mounted on the hinge side of the door. The torsional spring has a mid-portion crank which extends through an access opening with a coupler to the jamb or door frame. A pneumatic dampener is mounted in opposed relation to the torsion spring crank to slow the closing action induced by the coil spring. Adjustment means are provided in the dampener to emperically adjust its action prior to and after installation.

In view of the foregoing it is a principal object of the present invention to provide an integrally mounted door closer adjacent a lateral edge of the door having its mounting hinge to the end that a separate individual external mounted door closer, normally at the top of the door, is eliminated.

A further object of the present invention is to provide a torsional spring door closer which is hidden from the exterior by being at an interior portion of the opposed faces of the door, and extending only to couple with an anchor on the door jamb leaf of the door hinge.

Yet another object of the present invention is to provide one or more torsional integrally mounted door closer springs on the hinged edge of a door the cost of which is normally offset by the elimination of an externally secured door closer.

Also, another object of the present invention is to provide an integrally mounted torsion spring closer on a door having a hollow interior which can be replaced by the owner in the event there is a spring breakage.

But another object of the present invention is to provide such a torsional spring door closer element for positioning adjacent the hinge portion of a door having a hollow interior which is aesthetically discrete in that it cannot be seen from the outside of the door, and is additionally shielded from total view on the inside of the door. An alternative object of the present invention is to provide a torsional spring door closer which is housed in a cartridge for insertion on the left or the right-hand side of the door which will facilitate replacement of the door closer should it become disabled in use.

BRIEF DESCRIPTION OF THE ILLUSTRATIVE DRAWINGS

The foregoing objects and advantages of the present invention will be more fully understood as the following description of an illustrative embodiment takes place, taken in conjunction with the accompanying drawings, in which.

DESCRIPTION OF A PREFERRED EMBODIMENT

Figure 1:
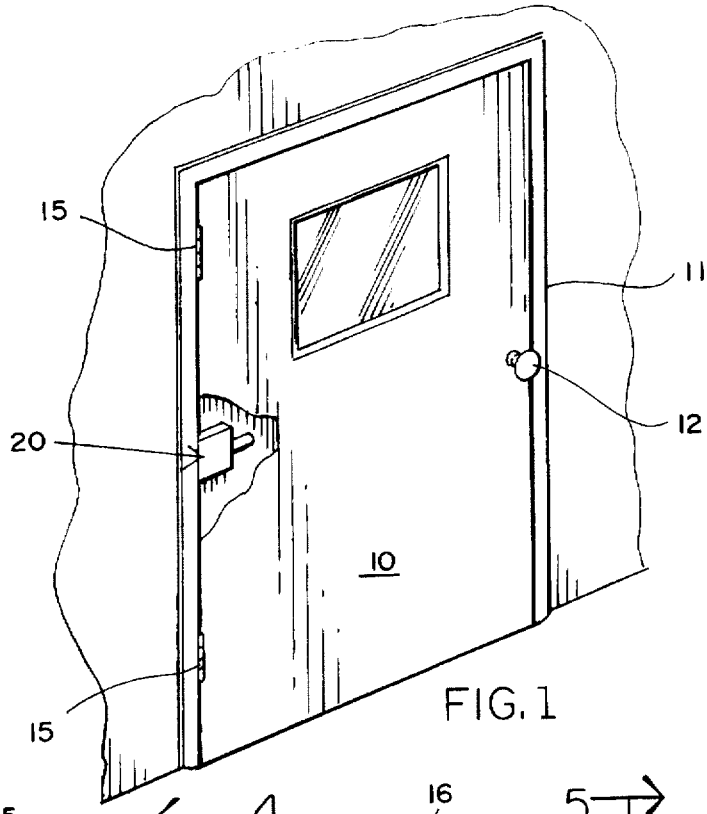
FIG. 1 is a perspective, partially broken view of a door mounted in a frame in the wall of a building structure showing the handle on one side of the door and the hidden closer on the other.
Figure 2:
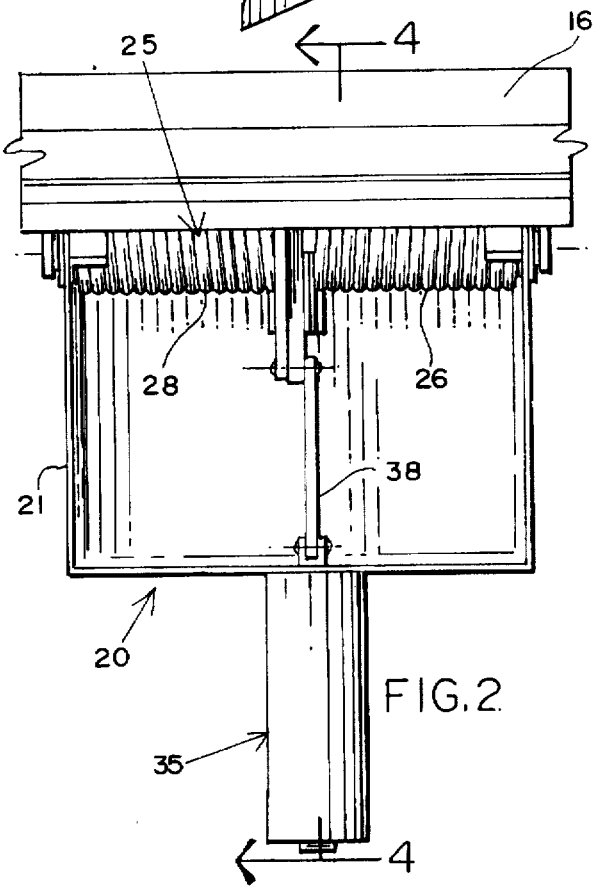
FIG. 2 is a plan view of the subject closure partially broken to show the interior members.

Illustrative of the present invention is a door 10 shown in FIG. 1 having a surrounding frame 11, an opening handle 12, a hinge 15, the same being hinged to a Z-bar 16 not shown in FIG. 1 but in subsequent Figures. More particularly with reference to FIG. 2 it will be seen that the closer 20 has a housing 21 which essentially surrounds the operating elements with a rectangular box structure. A torsion spring assembly 25 is positioned along the edge of the door to which the door hinge is mounted with the axis of the upper spring 26 and lower spring 28 being essentially parallel to the axis of the door hinge pin.

Figure 3:
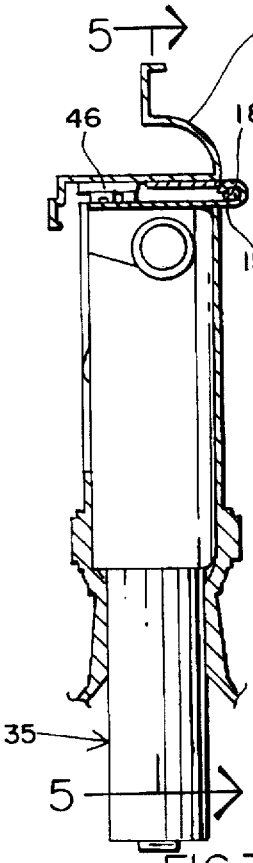
FIG. 3 is an end view of the closure shown in FIG. 1 in the closed position of the door.
Figure 4:
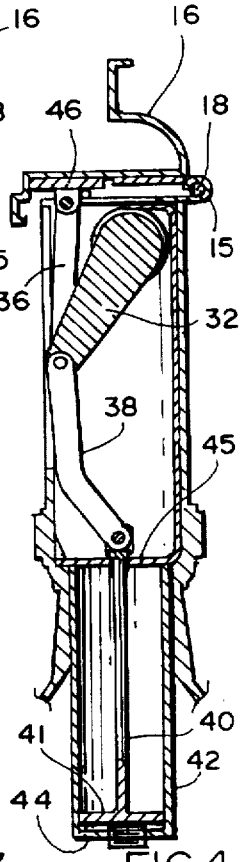
FIG. 4 is a cut-away view taken essentially along section lines 4—4 of FIG. 2 illustrating the interior portion of the closer.

As shown in FIGS. 3 and 4, the coil spring assembly 25, in the door closed position as shown in FIGS. 3 and 4, is exerting its unwound static effort against a crank 32 which, in turn, connects to the dampener assembly 35, a door link 36, and a dampener link 38. To be noted also is a door link mount 46 secured to the door link 36 which serves to pivotally couple the door link 36 to the door jamb or Z-bar 16 (see also FIGS. 6 and 7).

Figure 5:
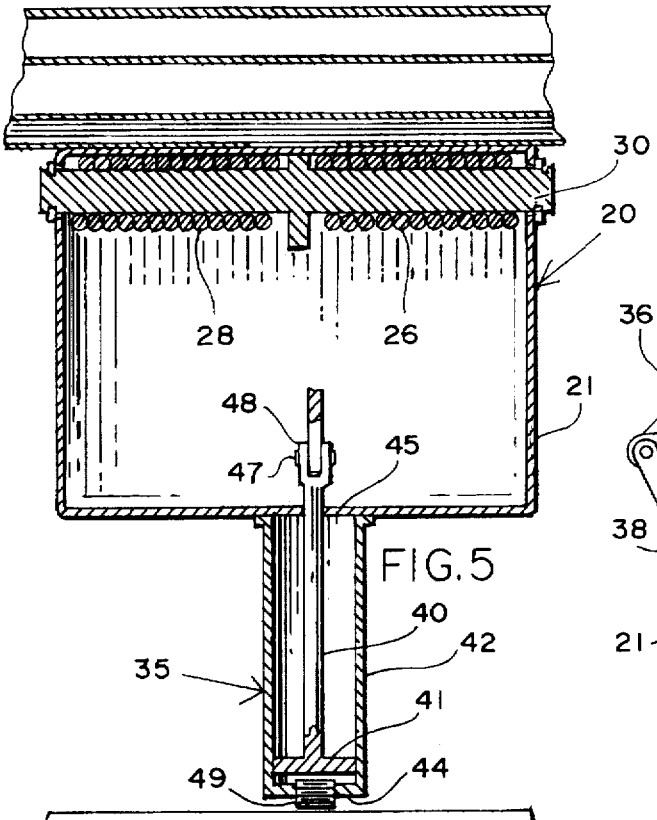
FIG. 5 is yet another view comparable to that of FIG. 2 but taken along section line 5—5 of FIG. 3.
Figure 8:
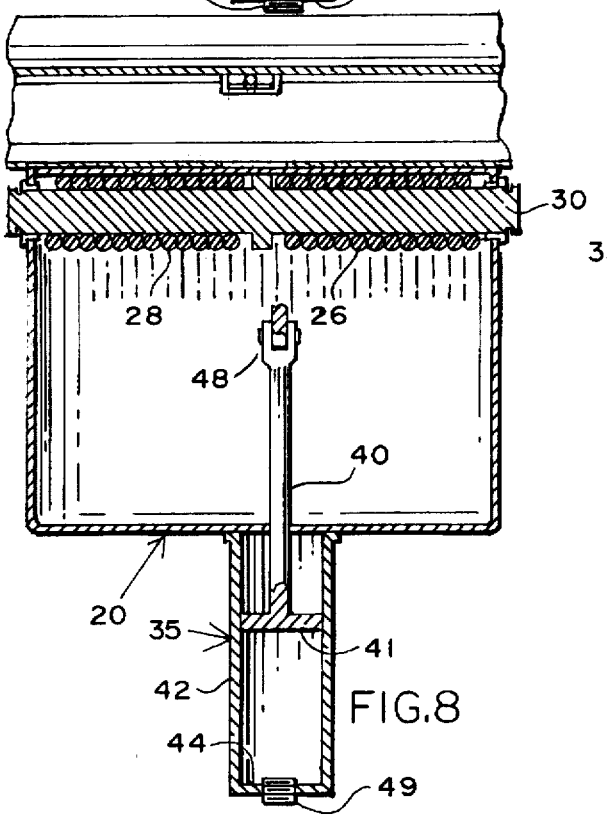
FIG. 8 is a view comparable to that of FIG. 5, but showing the door in a partially opened condition, rather than closed as is shown in FIG. 5.

Functionally, the dampener rod 40 (as shown in alternative positions in FIGS. 5 and 8) connects to a dampener piston 41 interiorly of a dampener cylinder 42. The function of the dampener, yieldable in nature, is to retard the latter portion of the closing cycle of the door to the end that the door does not slam against the jamb or frame. To be noted is the dampener regulator 49 which can emperically adjust the action of the dampener.

Figure 9:
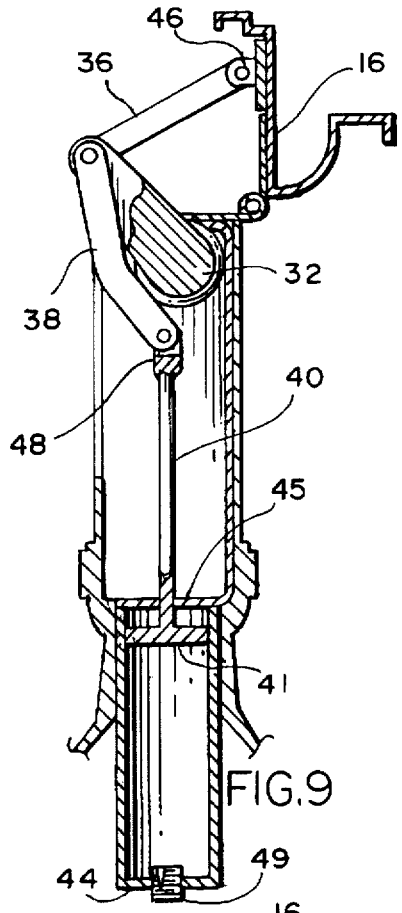
FIG. 9 is a view comparable to FIGS. 3, 4, 6, and 7 but illustrating the door in the full open condition.

Turning now to FIG. 9, it will be seen that when the door is in the full open position, 90° with the Z-bar 16, the piston 41 of the dampener assembly 35 is immediately adjacent the cylinder packer 45 and remotely spaced from the cylinder end 44. At this point the torsion spring assembly 25 is fully "wound" and contains its maximum amount of dynamic potential kinetic energy which will be released when a person entering the door releases the door to be closed by the closer 20.

Figure 10:
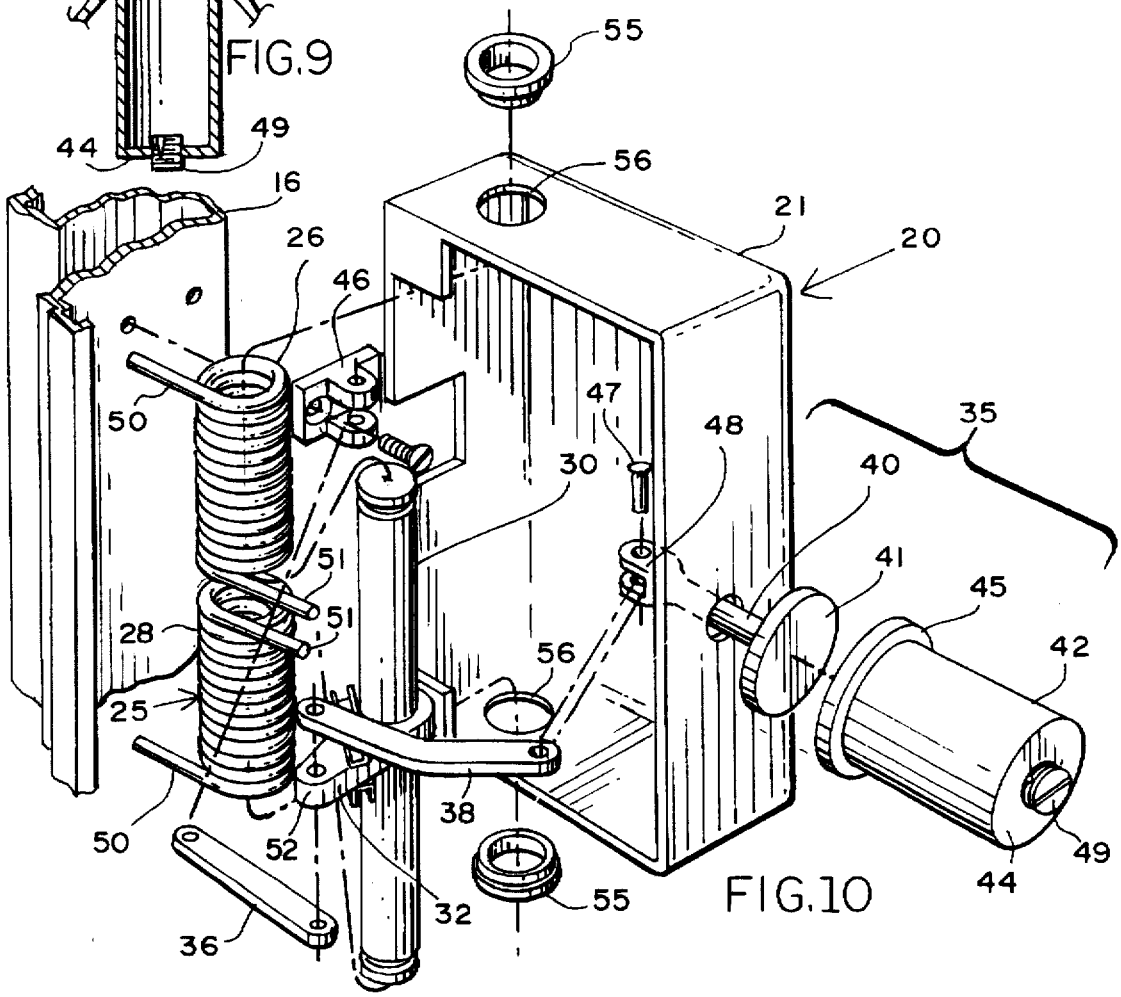
FIG. 10 is an enlarged partially broken exploded perspective view of the closer.

FIG. 10 discloses the bulk of the critical parts of the closer 20 and more particularly the torsion assembly 25, the dampener assembly 35 and the relationship between their respective elements. As shown in FIG. 10, there are two coil springs, the upper spring 26 and the lower spring 28. The two springs are coaxially seated on a spring shaft 30. The spring shaft 30, in turn, contains a crank 32 to which the door link 36 and the dampener link 38 are pivotally secured. While two springs 26, 28 are shown and provide for balancing, a single spring or multiples are contemplated as alternatives. The dampener link 38 leads to the dampener assembly 35, and couples to the dampener rod 40 through the coupler yile 48 and secured by pin 47. The dampener rod 40 has a dampener piston 41 on its end remote from the link 38 to the crank 32, and interiorly of the dampener cylinder 42 spaced from the cylinder end 44, and secured in place by means of the cylinder packer 45.

Figure 11:
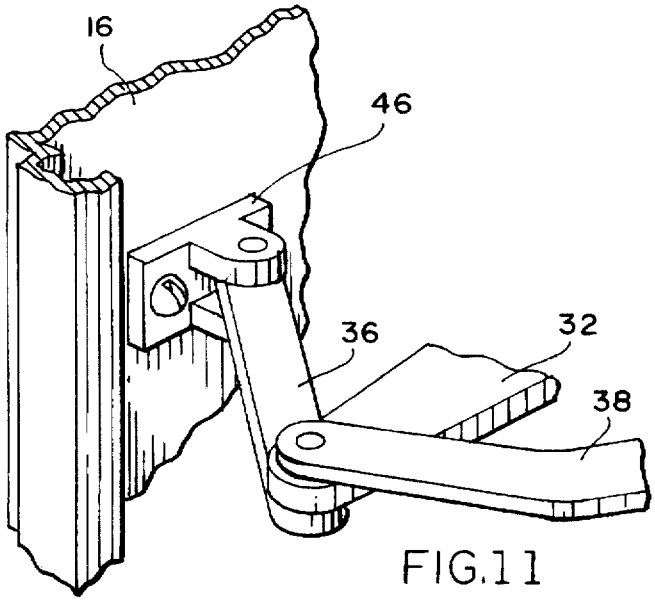
FIG. 11 is a "birds eye" view of the door link and dampener link which both connect to the torsion spring crank.

To be noted are spring feet 50 which are tails of the torsional springs which engage flat surfaces on the interior of the housing 21. Opposed to the spring feet 50 are the spring drivers 51 which are secured pivotally to the crank mount 52. The spring shaft 30 is secured in position by spring shaft seats 55 at opposed ends of the spring shaft 30, with the seats being mounted in shaft seal mount holes 56. The door link mount 46, as disclosed particularly in FIG. 11, is secured to the Z-bar 16, directly adjacent one leaf of the door hinge 60.

Figure 6:
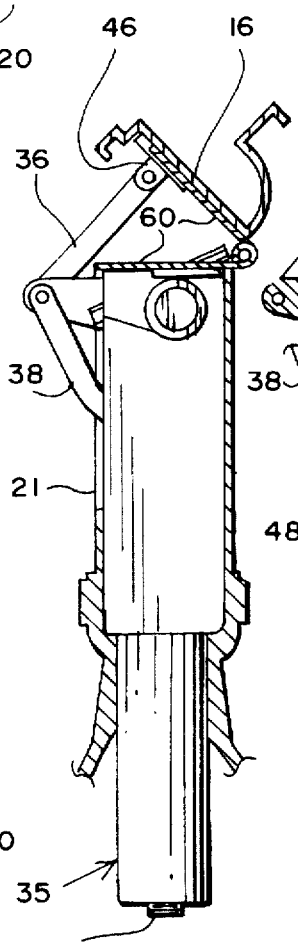
FIG. 6 is a view comparable to FIG. 3 but showing the door swung open 45° from its normal closed condition.
Figure 7:
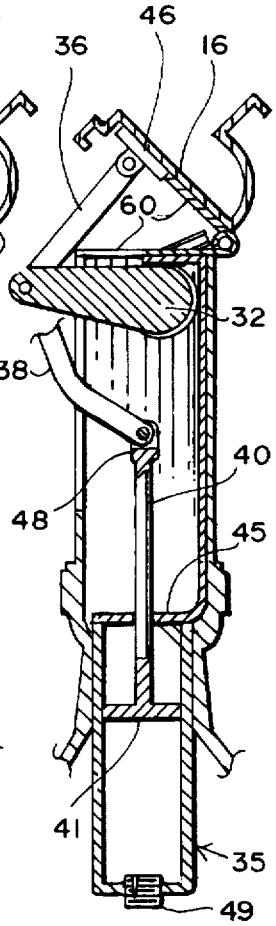
FIG. 7 is a view comparable to FIG. 4, but also showing the door in a 45° open position.

The operation of the closer 20 is straightforward. As the door is open the torsion spring assembly 25 winds itself and stores dynamic potential kinetic energy. This is true whether the door is 45° opened as shown in FIGS. 6 and 7, or totally opened as illustrated in FIG. 9. When the door 10 is released, the torsion assembly 25 experiences an unwinding of the upper spring 26 and the lower spring 28 which effort is transmitted through the crank 32 to the door link 36 and then to the door link mount 46 to pull the door 10 shut, and at the same time the effort is partially offset by the effect of the dampener assembly 35.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. For use in a door having a hollow interior closer receiving portion, said door having two lateral edges, one such lateral edge having a latch assembly and the other lateral edge having a hinge assembly securing the same to a door frame, which frame includes a jamb, a door closer comprising, in combination, a torsion spring assembly, said assembly having one or more torsion springs and, a torsion spring shaft secured to said one or more torsion springs for the rotation of said shaft, said shaft having a crank which is secured to the torsion spring shaft which shaft is rotationally mounted about its axis, a door link and dampener link extending in opposite directions from and secured to the crank, the door link being secured to a door link mount secured on the door jamb, and the dampener link being secured to a dampener assembly, whereby the door closer including the dampener assembly may be mounted interiorly of a door adjacent the hinge edge for closing the door and dampening the closing of the door by retarding the torsion spring means with a pre-determined offsetting effort by the dampener assembly.

2. The closer of claim 1, wherein:

said dampener assembly comprises a tubular housing, and pneumatic piston means proportioned to fit within the tubular housing of the dampener assembly, said piston means including a rod having an end mount for pivotal securement to the dampener link.

3. The closer of claim 1, wherein:

said dampener assembly has adjustable means for adjusting the dampening action by means of a pneumatic relief valve.

4. The closer of claim 2 above, wherein:

said tubular housing has a cylindrical portion, where said cylindrical portion has a closed end, and where said cylindrical portion at its end opposite the just-recited end has a cylinder packer for receiving said rod.

5. For use in a door having a hollow interior closer receiving portion, said door having two lateral edges, one such lateral edge having a latch assembly and the other lateral edge having a hinge assembly securing the same to a door frame, which frame includes a jamb; a door closer comprising, in combination, a torsion spring, a torsion spring shaft to which said spring has been coaxially secured for the rotation of said shaft, said shaft having a crank which is secured to the shaft to rotate with the shaft, said spring being secured at one end to the shaft and at the other end to the door closer, a door link and dampener link extending in opposite directions from and secured to the crank, a door link dampener assembly, a door link mount secured on a door jamb, means securing the dampener link to the dampener assembly, and, means securing the door link to the door link mount, whereby the door closer including the dampener assembly may be mounted interiorly of a door adjacent the hinge edge for closing the door and dampening the closing of the door by retarding the torsion springs with a pre-determined offsetting effort by the dampener assembly.

6. The closer of claim 5, wherein:

said dampener assembly comprises a tubular housing, means for securing said dampener assembly tubular housing to the closer, and pneumatic piston means proportioned to fit within the tubular housing of the dampener assembly, said piston means including a rod having an end mount for pivotal securement to the dampener link.

7. The closer of claim 6, wherein:

said dampener assembly has adjustable means for adjusting the dampening action by means of a pneumatic relief valve.

8. For use in a door to be mounted in a door frame, which frame includes a door jamb, a door having a hollow interior closer receiving portion, said door having two lateral edges, one such lateral edge having a latch assembly and the other lateral edge having a hinge assembly having a hinge axis secured to a door frame, a housing for housing a door closer assembly, a door closer assembly comprising, in combination, a torsion spring assembly, said torsion spring assembly having a torsion spring, and a torsion spring shaft to which said spring is coaxially secured for the rotation of said shaft, a dampener assembly, a door link and dampener link extending in opposite directions from and secured to the spring assembly, a door link mount secured to the door jamb, the door link secured to the door link mount secured on the door jamb, and the dampener link being secured to the dampener assembly, the torsion spring shaft being secured in the housing adjacent the door hinge edge with the torsion spring axis in parallel spaced relation to the door hinge axis, whereby the door closer assembly including the dampener assembly may be mounted interiorly of a door adjacent the hinge edge for closing the door and dampening the closing of the door by retarding the torsion spring with a pre-determined offsetting effort by the dampener.

9. The closer of claim 8, wherein:

said dampener assembly comprises a tubular housing, means for securing said tubular housing to the housing for the closer, and pneumatic piston means proportioned to fit within the tubular housing of the dampener assembly, said piston means including a rod having an end mount for pivotal securement to the dampener link.

10. The closer of claim 9, wherein:

said dampener assembly has adjustable means for adjusting the dampening action by means of a pneumatic relief valve.

11. The method of assembling a door closer in a door in a door frame, said door having a hinged edge and said door frame having a hinged edge, a hinge on said door hinge edge and joined to said door frame hinged edge, said hinge having a hinge axis comprising the steps of:

orienting a recess opening in a door in open communication with the hinged edge of the door, positioning a torsion spring having an axis interiorly of the opening and parallel with the door hinge axis by placing a shaft through the torsion spring and operatively secured to the spring, securing the shaft to the interior portion of the door so that the torsion spring can be wound and unwound by the rotation of the door about its hinge, securing one portion of the torsion spring through a linkage means to the door frame hinged edge, positioning a dampener interiorly of the opening recess in the door, and securing the dampener to the torsion spring for coaction therewith, whereby opening and closing the door will sequentially wind and unwind the spring while the spring remains buried interiorly of the door and the closing of the door is dampened by the dampener.

12. In the method of claim 11 above, balancing the torsion load of the torsion spring with the dampening effect of the dampener to the end that the dampener at all times exerts a modest effort in opposition to the closing action of the spring at the instigation of closing and continually absorbs the dynamic effort of the spring and closing until the door itself is closed at which time it continues to exert a relaxed pressure against the torsion spring.

* * * * *